United States Patent [19]

Gonzales

[11] 4,396,812

[45] Aug. 2, 1983

[54] ELECTRIC, KEY-CONTROLLED SWITCH LOCK

[75] Inventor: Roman Y. Gonzales, Andover, Mass.

[73] Assignee: Gould, Inc., Rolling Meadows, Ill.

[21] Appl. No.: 326,610

[22] Filed: Dec. 2, 1981

[51] Int. Cl.[3] ..... H01H 9/28; H01H 27/06

[52] U.S. Cl. ..... 200/44; 200/292; 200/42 R; 200/448

[58] Field of Search ..... 200/42 R, 44, 67 DB, 200/303, 292, 153 LB; 70/448, 449

[56] References Cited

U.S. PATENT DOCUMENTS

| | | | |
|---|---|---|---|
| 3,206,567 | 6/1961 | Grimm | 200/44 |
| 3,286,773 | 11/1966 | Russell et al. | 70/449 |
| 3,719,788 | 3/1973 | Holland | 200/292 |
| 3,742,161 | 6/1973 | Lipschotz | 200/44 |
| 3,877,261 | 4/1975 | Robins | 70/448 |
| 4,045,637 | 8/1977 | Mongeau | 200/303 |
| 4,136,269 | 1/1979 | Weidler | 200/159 A |
| 4,267,412 | 5/1981 | Janssen et al. | 200/303 |
| 4,276,453 | 6/1981 | Wolter | 200/44 |

FOREIGN PATENT DOCUMENTS

| | | | |
|---|---|---|---|
| 1198397 | 8/1958 | France | 200/44 |
| 2022924 | 12/1979 | United Kingdom | 200/44 |

*Primary Examiner*—Stephen Marcus
*Assistant Examiner*—Ernest G. Cosick
*Attorney, Agent, or Firm*—Mattern, Ware, Stoltz & Fressola

[57] ABSTRACT

By providing a key actuated tumbler, rotationally journaled in a housing in juxtaposed spaced relationship to a pair of contacts, one of which comprises an elongated resiliently flexible member, with the tumbler incorporating actuating means for controllably moving the flexible contact from its first non-conductive position to its second conductive position, an inexpensive, easily manufactured and installed electric, key-controlled switch lock is achieved. In the preferred embodiment, the tumbler is mounted in a housing which incorporates a contact holding zone for positioning and maintaining the tumbler and the flexible contact in juxtaposed spaced cooperating relationship with the entire assembly directly mountable to a printed circuit board for initiating and terminating the flow of electric current thereto. In addition, in the preferred embodiment of the present invention, the tumbler incorporates an eccentrically disposed ridge formed about its outer peripheral surface as the actuating means for controllably moving the flexible contact between its two positions.

11 Claims, 7 Drawing Figures

ELECTRIC, KEY-CONTROLLED SWITCH LOCK

BACKGROUND OF THE INVENTION

1. Field of the Invention

This invention relates to key-controlled switch lock assemblies and more particularly to electric, key-controlled switch lock assemblies for use with printed circuit boards.

2. Description of the Prior Art

Although much effect has been expended in developing various key-controlled switch lock systems for burglar alarms, automobile ignition and warning systems, and the like, all of these systems suffer from being complex, multipart systems which are expensive to manufacture and assemble. Instead of advancing towards qualities of simiplicity of operation, ease of manufacture and rapid assembly, prior art key-controlled switch lock devices have become increasingly complex in their construction, assembly and operation.

Furthermore, in the particular field of printed circuit board based equipment, such as computers, machine controllers, and other programmable electronic equipment, very little effort has been expended in constructing a key actuated switch lock for direct use with printed circuit boards in order to provide controlled access thereto. Presently, the only key actuated switch lock mechanisms employed in programmable electronic equipment and other printed circuit board based computers and controllers are conventional key lock switches. The key lock switches are expensive to manufacture and extremely costly to install for use with such equipment.

The only prior art patent directed to a key switch device for use with printed circuit boards, of which the present inventor is aware, is Sasuki U.S. Pat. No. 4,185,179. However, the Sasuki key switch device is totally inapplicable to the present invention, since that key switch device does not employ and does not teach a tumbler actuated switch lock which is rotated by the axial rotational movement of an actuating key between an OPEN and CLOSED position. Instead, the key-switch device of Sasuki employs a key which is moved laterally about an axis perpendicular to the central axis of the key, causing contacts to move laterally between a plurality of alternate positions, making contact between various modes of operation. In addition, the key-switch device of Sasuki suffers from the typical prior art drawbacks of requiring a plurality of components which are difficult to manufacture and assemble.

It is the principal object of the present invention to provide an electric, key-controlled switch lock which is easily and inexpensively manufactured and employable for initiating and terminating the flow of electric current through a printed circuit board.

Another object of the present invention is to provide an electric, key-controlled switch lock having the characteristic features defined above which can be directly mounted to a printed circuit board, easily and inexpensively.

Another object of the present invention is to provide an electric, key-controlled switch lock having the characteristic features defined above which is capable of providing restricted use of the electrical system to which it is operatively connected.

Another object of the present invention is to provide an electric, key-controlled switch lock having the characteristic features defined above which is manufactured from a minimum number of components all of which are quickly and easily assembled into the final product.

Other and more specific objects will in part be obvious and will in part appear hereinafter.

SUMMARY OF THE INVENTION

The present invention eliminates all of the drawbacks encountered with prior art key lock systems by providing a rapidly assemblable two component housing having a tumbler rotationally journaled therein. The tumbler is constructed for receiving one end of an actuating key and for being rotationally moved about its central axis by the rotational movement of the actuating key.

The tumbler incorporates actuating means extending radially from the outer peripheral surface of the tumbler. Also, the tumbler is positioned in juxtaposed spaced relationship to a pair of contacts, one of which is closest to the tumbler and is resiliently flexibly deformable towards the second contact in response to the actuating means of the tumbler. In this way, the rotational movement of the tumbler by the actuating key causes the tumbler to move from a contact OPEN position to as contact CLOSED position, thereby initiating the current flow to the system to which the contacts are mounted.

This easily manufactured housing and tumbler construction is quickly and easily assemblable as well as easily installed directly on a printed circuit board, overlying the current flow controlling contacts for direct, key-controlled switching movement thereof.

The present invention achieves an inexpensive, electric, key-controlled switch lock which is installable directly on a printed circuit board, providing an inexpensive means for assuring restricted, controlled initiation and termination of electric current to the printed circuit board based equipment. The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
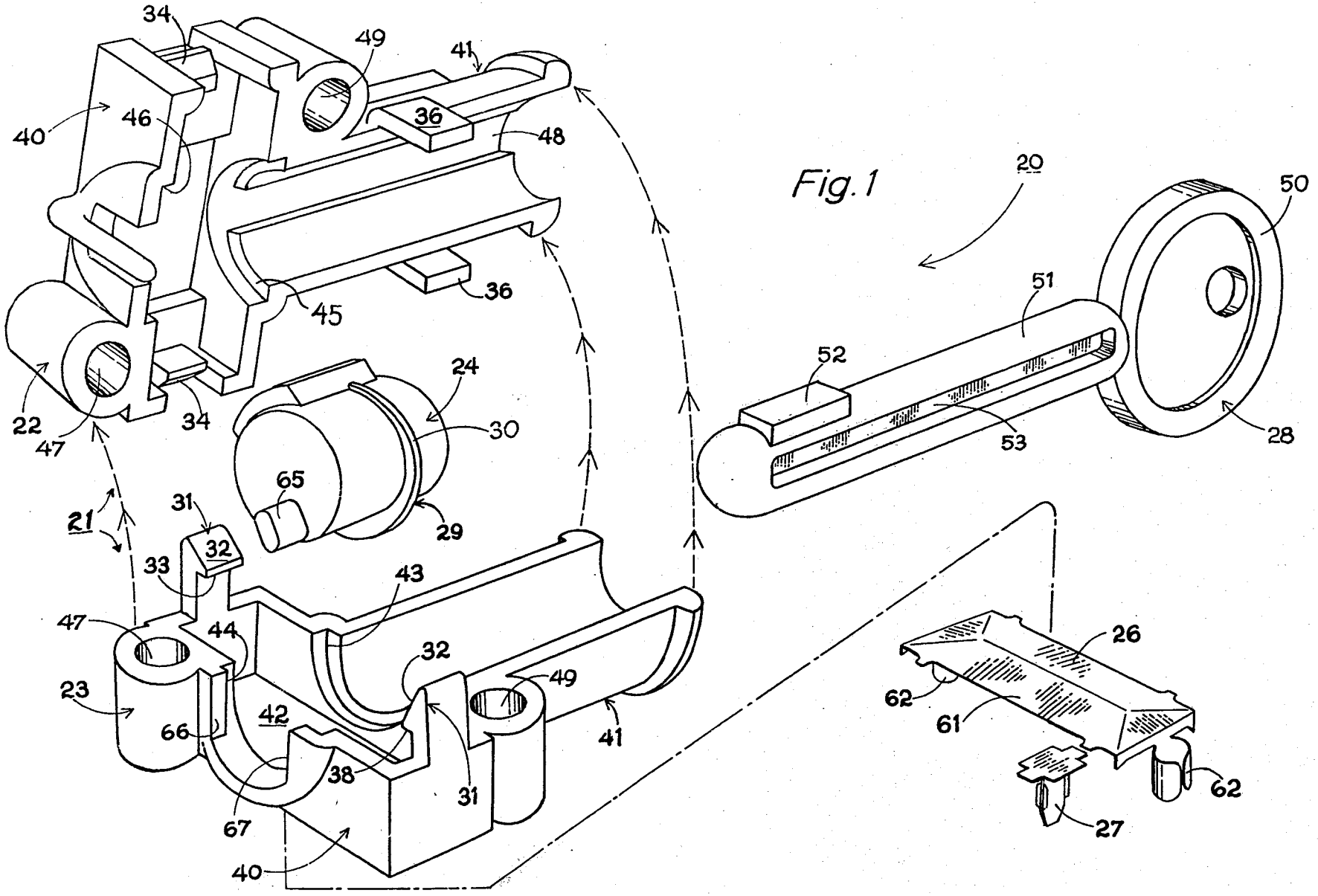
FIG. 1 is an exploded perspective view of the electric, key-controlled switch lok of the present invention.

As shown in FIG. 1, electric, key-controlled switch lock 20 of the present invention comprises a housing 21 formed of an upper housing portion 22 and a lower housing portion 23, a tumbler 24, a flexible contact 26, a fixed contact 27, and an actuating key 28. Tumbler 24 is rotationally journaled in housing 21 for movement therein in response to rotational movement of key 28. In addition, current controlling contacts are positioned in operative relationship to tumbler 24 for controlled interactive movement in response to the rotational movement of tumbler 24. As a result, with these components, the entire electric, key-controlled switch lock 20 of the present invention is achieved, inexpensively providing controlled, restricted initiation and termination of electric power to the printed circuit board to which switch lock 20 is mounted.

Housing

As best seen in FIG. 1, housing 21 comprises two mating housing portions 22 and 23, which are quickly and easily lockingly interconnected with each other. In order to assure secure locked engagement of upper housing portion 22 with lower housing portion 23, lower housing portion 23 incorporates two upstanding flexible locking arms 31, each of which incorporates a bevelled camming surface 32 and a locking surface 33. Upper housing portion 22 incorporates cooperating cam surface 34 and locking surface 35, shown in FIGS. 3 and 5. In addition, upper housing portion 22 incorporates retaining arm 36 extending therefrom for cooperation with the outer peripheral surface of lower housing portion 23 to prevent unwanted side to side movement therebetween.

With this construction, upper housing portion 22 and lower housing portion 23 are quickly and easily interconnected by aligning the two housing portions with camming surfaces 32 of the flexible arms 31 placed in sliding contact with camming surfaces 34 of upper housing portion 22. Then, by advancing housing portions 22 and 23 towards each other, camming surfaces 32 of flexible arms 31 slidingly advance along cam surfaces 34 of upper housing portion 22, causing flexible arms 31 to move outwardly until camming surfaces 32 and 34 are no longer in sliding engagement and locking surface 33 of flexible arm 31 snaps into direct locked engagement with locking surface 35 of upper housing 22. This final position is shown in both FIGS. 3 and 5.

As is readily apparent from the preceding description, separation of housing portions 22 and 23 are easily achieved by merely moving flexible arms 31 outwardly until locking surfaces 33 and 35 are not in direct contact with each other. With the locking surfaces disengaged, housing portions 22 and 23 can be easily separated.

In its overall construction, housing 21 comprises a rectangular portion 40 and a cylindrical portion 41, with upper housing portion 22 and lower housing portion 23 each comprising substantially one-half of the overall rectangular portion 40 and the cylindrical portion 41. Rectangular portion 40 of lower housing portion 23 incorporate a contact receiving zone 42 forming the lower open end thereof. Cylindrical portion 41 of upper housing 22 incorporates an elongated channel 48 formed in the inside surface of cylindrical portion 41 and extending the entire length thereof.

Rectangular portion 40 of lower housing portion 23 also incorporates a forward tumbler receiving and guiding groove 43, which is substantially semi-circular in shape, as well as a cooperating, juxtaposed, spaced, rearward tumbler receiving and guiding groove 44. As best seen in FIG. 1, tumbler receiving and guiding groove 43 is formed at the intersection of rectangular portion 40 and cylindrical portion 41.

Similarly, upper housing 22 incorporates a tumbler retaining and guiding groove 45 formed at the intersection between cylindrical portion 41 and rectangular portion 40. In addition, rectangular portion 40 of upper portion 22 also incorporates a second, rearwardly disposed tumbler retaining and guiding groove 46, in juxtaposed spaced relationship to groove 45.

Figures 2, 3, 4, 5, 6, 7:
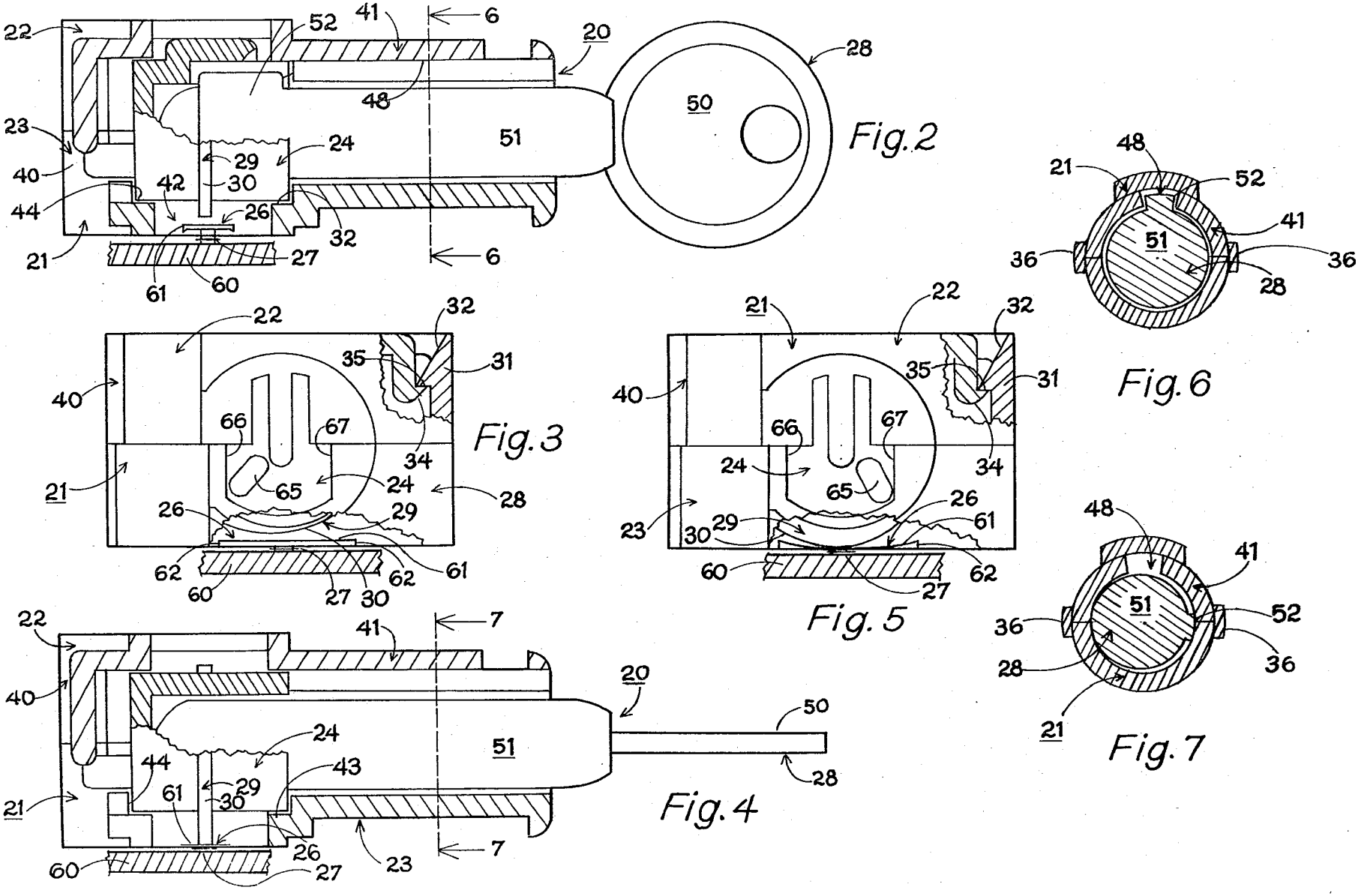
FIG. 2 is a side elevation view partially in cross section showing the electric, key-controlled switch lock of the present invention in the OPEN position.
FIG. 3 is a rear elevation view, partially in cross section, of the electric, key-controlled switch lock of the present invention in the OPEN position.
FIG. 4 is a side elevation view, partially in cross section of the electric, key-controlled switch lock of the present invention shown in the CLOSED position.
FIG. 5 is a rear elevation view, partially in cross section, of the electric, key-controlled switch lock of the present invention shown in the CLOSED position.
FIG. 6 is a cross sectional front elevation view of the electric, key-controlled switch lock of the present invention taken along lines 6—6 of FIG. 2.
FIG. 7 is a cross sectional front elevation view of the electric, key-controlled switch lock of the present invention taken along lines 7—7 of FIG. 4.

As is readily apparent from FIGS. 1, 2, and 4, grooves 43 and 45 cooperatingly relate to form a circular tumbler retaining groove, when upper housing portion 22 and lower housing portion 23 are in locked engagement. Similarly, grooves 44 and 46 cooperate to form a corresponding tumbler receiving and guiding groove. When housing portions 22 and 23 are in interlocked engagement, these cooperating semicircular grooves capture and retain tumbler 24 rotationally journaled in housing 21. In addition, housing 21 preferably incorporates cooperating printed circuit board mounting holes 47 and 49 formed on both upper housing portion 22 and lower housing portion 23 in order to assure quick and easy securely mounting engagement of housing 21 directly to the printed circuit board, if so desired.

Key

As best seen in FIG. 1, key 28 incorporates a head portion 50, an elongated shaft 51 and an upstanding bit 52 formed near the distal end of shaft 51. Shaft 51 is dimensioned to have an outer diameter smaller than the inside diameter of cylindrical portion 41, in order to assure ease of insertion and rotation of key 28 therein. Furthermore, elongated channel 48 is dimensioned for longitudinal guiding receipt of bit portion 52 of key 28. As shown in FIG. 1, key 28 may incorporate optional elongated slot or recess 53, in order to reduce the amount of material necessary to form shaft 51.

Tumbler

Tumbler 24 is constructed with an overall cylindrical shape, having a portal entry zone designed to receive the distal end of shaft 51 and upstanding bit 52. In this way, with tumbler 24 rotationally journaled within housing 21, rotational movement of key 28 causes simultaneous, controlled, rotational movement of tumbler 24 within housing 21.

Tumbler 24 also comprises a contact actuating ridge 29 radially extending from the outer peripheral surface of tumbler 24. In the preferred embodiment, ridge 29 is substantially continuous about a major portion of a circumferential arc of tumbler 24. In addition, ridge 29 is eccentrically mounted to the outer peripheral surface of tumbler 24. As a result, the distance between the outer peripheral surface of tumbler 24 and the outer cam surface 30 of ridge 29 is different for each point along the arcuate length of ridge 29. Tumbler 24 also incorporates a rotation limiting pin 65 extending from the rear surface thereof, which is in cooperative retained engagement with pin contact surfaces 66 and 67 formed in lower housing 23.

Contacts

Controlled initiation and termination of electric current through the printed circuit board is achieved by employing resiliently flexible contact 26 and fixed contact 27. In the preferred construction, fixed contact 27 is securely mounted to printed circuit board 60 with flexible contact 26 also mounted to printed circuit board 60. However, flexible contact 26 incorporates an elongated flexible plate 61 with printed circuit board connecting posts 62 extending from opposed edges of plate 61. Posts 62 are securely mounted to printed circuit board 60, leaving flexible plate 61 extending over printed circuit board 60 in juxtaposed spaced relationship thereto, overlying contact 27.

In the preferred assembly, flexible contact 26 is positioned within contact receiving zone 42 of housing 21, with elongated resiliently flexible plate 61 of contact 26 in juxtaposed spaced relationship between contact 27 and eccentrically mounted ridge 29 of tumbler 24. This construction and arrangement is best seen in FIG. 2.

Operation

By comparing FIGS. 3 and 5, the controlled rotational movement of tumbler 24 and the overall operation of switch lock 20 can best be understood. As shown in FIG. 3, rotation limiting pin 65 of tumbler 24 is in abutting contact with rotation limiting surface 66 of housing 21. When in this position, tumbler 24 is in the OPEN position with tumbler 24 positioned for receipt of key 28 therein, as depicted in FIG. 2.

Once key 28 is fully inserted into tumbler 24, key 28 can then be axially rotated, producing simultaneous, controlled axial rotation of tumbler 24. As is readily apparent from FIG. 3, key 28 can only be axially rotated in one direction, since any rotation in the opposed direction is prevented by abutting contact between pin 65 and surface 66. When key 28 is axially rotated through its arc of about 90°, as shown in FIGS. 4 and 5, the key-controlled switch lock 20 of the present invention moves from the OPEN position to the CLOSED position, due to the interaction between resiliently flexible contact 26 and ridge 29 of tumbler 24.

The axial rotation of key 28 through its arc of about 90° causes tumbler 24 to rotate through an identical rotational arc, which also causes contact 26 to close with contact 27, thereby initiating the flow of electric current through the printed circuit board. Any further axial rotation of key 28 and tumbler 24 is prevented, since pin 65 of tumbler 24 directly abuts rotation resisting surface 67 of housing 21.

As a result, key 28 is capable of controlled axial rotation of tumbler 24 through an arc of only 90° in a single direction, and back again to the original direction. In this way, the controlled initiation and termination of electric current through the printed circuit board is assured, requiring only a simple, positive, easily achieved, 90° turn in the desired direction.

The mechanism employed in the present invention to provide controlled initiation and termination of electric current through the printed circuit board can best be understood by referring to FIGS. 2–5. In FIGS. 2 and 3, the OPEN position is shown with key 28 fully inserted in housing 21 and tumbler 24, with tumbler 24 rotationally journaled in housing 21. In this position, eccentrically mounted ridge 29 of tumbler 24 is in juxtaposed spaced relationship to flexible plate 61 of contact 26, with flexible plate 61 also being in juxtaposed, spaced, overlying relationship to fixed contact 27.

When key 28 is axially rotated through its arc of about 90°, tumbler 24 is simultaneously controllably rotated through the identical arc. As tumbler 24 is rotationally advanced through this arc, outer cam surface 30 of eccentrically mounted ridge 29 advances towards elongated flexible plate 61 of contact 26. As the arc of rotation approaches its 90° limit, outer peripheral cam surface 30 of ridge 29 contacts elongated flexible plate 61 of flexible contact 26, causing plate 61 to conform to the shape of ridge 29, advancing plate 61 towards fixed contact 27. When key 28 and tumbler 24 have been axially rotated through their entire 90° arc, eccentrically mounted ridge 29 has forced plate 61 of contact 26 to advance into direct engagement with contact 27, thereby closing these switch contacts and assuring the flow of electric current to the printed circuit board. This CLOSED position is shown in FIGS. 4 and 5.

In the preferred construction, elongated, resiliently flexible plate 61 of contact 26 comprises an overall shape and structure which assures the return of contact 26 to its original position when eccentrically mounted ridge 29 is removed from direct abutting contact therewith. Consequently, when key 28 and tumbler 24 have been rotated from the CLOSED position as shown in FIGS. 4 and 5, to the OPEN position as shown in FIGS. 2 and 3, the removal of eccentric ridge 29 from abutting engagement with flexible contact 26 causes flexible contact 26 to spring back to its original position, thereby terminating the flow of electric current to the printed circuit board and producing a "OPEN" switch position.

In FIGS. 6 and 7, the rotational movement of bit 52 of key 28 from an unlocked position to a locked, captured position is depicted. In FIG. 6, key 28 is shown with shaft 51 rotationally journaled in cylindrical portion 41 of housing 21, with bit 52 of key 28 free to move axially inwardly and outwardly of cylindrical portion 41 of housing 21 along bit channel 48. However, when key 28 has been rotated through its 90° arc, bit 52 is no longer aligned with bit channel 48, thereby causing bit 52 to be locked within cylindrical portion 41 of housing 21.

In this position, with the printed circuit board electricly activated, key 28 is incapable of being withdrawn from cylindrical portion 41. In order to remove key 28, key 28 must be rotated back to its original position, resulting in the contacts being OPEN.

Based upon the preceding description, it is readily apparent that the present invention achieves an efficient, easily manufactured, and easily assembled electric, key-controlled switch lock. Furthermore, it is also readily apparent that the electric, key-controlled switch lock of the present invention provide a controlled, restricted switch construction which can be used with printed circuit boards and can be directly mounted to the printed circuit board without complex and expensive wiring or wiring harnesses. Consequently, a fast, efficient, and easily employable electric, key-controlled switch lock is achieved.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. An electric, key-controlled switch lock for initiating and terminating the flow of electric current through a printed circuit board, comprising A. a housing incorporating
  a. a key entry zone,
  b. a tumbler holding zone in juxtaposed, spaced, cooperating relationship with the key entry zone, said tumbler holding zone having an opening; and
  c. means for mounting the housing to the printed circuit board so that the tumbler opening overlies a portion of the printed circuit board;

B. a tumbler mounted for rotation about its central axis in the tumbler holding zone of the housing and comprising
  a. an open entry portal
    1. formed at a first end of the rotational axis thereof, and
    2. dimensioned for receipt of a rotation inducing key, and
  b. contact actuating means radially extending from the outer peripheral surface thereof and extendable through the tumbler opening when the tumbler is in a first or closed rotational position and at least less extended through the tumbler opening when the tumbler is in a second or opened rotational position;

C. a first contact having means for mounting to the printed circuit board;

D. a second, elongated, resiliently flexible contact
  a. having means for mounting to the printed circuit board in juxtaposed, spaced relationship thereto, overlying the first contact, and
  b. positionable to underlie the tumbler opening for cooperative, controlled responsive engagement with the actuating means of the tumbler so that the contact actuating means resiliently depresses the second contact to engage the first contact when the tumbler is in the closed position and to allow disengagement of the second contact from the first contact when the tumbler is in the opened position; and E. a key member
  a. insertable in the housing and the tumbler, and
  b. rotatable about its central axis, producing rotation of the tumbler from the second, or opened, position to the first or, closed, position, whereby axial rotation of the key and tumbler causes the actuating means of the tumbler to controllably engage and disengage the contacts.

2. The electric, key-controlled switch lock defined in claim 1, wherein the housing is further defined as comprising a substantially elongated portion interconnected at one end thereof to a substantially enlarged portion, with said enlarged portion incorporating 1. a pair of circular grooves in juxtaposed, spaced, cooperating relationship for holding and maintaining the tumbler in rotational engagement therewith, and
2. a contact holding zone defined by the tumbler opening and positioned in cooperating relationship between the tumbler holding grooves.

3. The electric, key-controlled switch lock defined in claim 2, wherein the second contact is further defined as comprising an elongated, resiliently flexible plate and wherein the second contact mounting means incorporates printed circuit board mounting pins at opposed ends of the plate for rapid mounted engagement with the printed circuit board, and is positionable in the contact holding zone, interposed between the tumbler and the first contact.

4. The electric, key-controlled switch lock defined in claim 2, wherein said housing is further defined as comprising two mating portions, in releasable interlocked engagement with each other, with each portion incorporating at least part of a tumbler retaining groove, whereby the tumbler is quickly and easily mounted in rotational engagement between said portions, and said portions are quickly and easily interlocked.

5. The electric, key-controlled switch lock defined in claim 4, wherein one of said portions is further defined as comprising at least one flexible arm incorporating a camming surface and a locking surface positioned for cooperative interengagement with a corresponding cam surface and locking surface formed on the opposed portion.

6. The electric, key-controlled switch lock defined in claim 1, wherein said tumbler is further defined as comprising a substantially cylindrical shape incorporating a continuous ridge projecting eccentrically from the outer peripheral surface of the tumbler substantially perpendicular to the central axis thereof, forming the radially extending actuating means.

7. The electric, key-controlled switch lock defined in claim 6, wherein said tumbler further comprises a rotation limiting pin extending from its second, closed end, and said housing incorporates a pin receiving and rotation limiting zone, for receipt of said tumbler pin and permitting controlled rotation thereof only through a limited arc, thereby assuring that the key-actuated rotation of the tumbler is limited between its first and second rotational positions.

8. An electric key-controlled switch lock as defined in claim 3, wherein the housing comprises two mating portions, releasably interlocked with each other, each portion incorporating at least part of a tumbler retaining groove, whereby the tumbler is quickly and easily mounted in rotational engagement between these portions, and wherein these portions are quickly and easily interlocked.

9. An electric, key-controlled switch lock as defined in claim 8, wherein one of the housing portions further comprises at least one flexible arm incorporating a camming surface and a locking surface positioned for cooperative engagement with a corresponding cam surface and locking surface formed on the opposed housing portion.

10. An electric, key-controlled switch lock as defined in claim 9, wherein the tumbler further has a substantially cylindrical shape incorporating a continuous ridge projecting eccentrically outward from its peripheral surface in a direction substantially perpendicular to the central axis of the tumbler, thereby forming the radially extending actuating means.

11. An electric, key-controlled switch lock as defined in claim 10, wherein the tumbler further comprises a rotation limiting pin extending from its second, closed end and the housing incorporates a pin receiving and rotation limiting zone, for receipt of the tumbler pin so as to permit controlled rotation thereof only through a limited arc, thereby assuring that the key-actuated rotation of the tumbler is limited between its first and second rotational positions.

* * * * *